US010962267B2

(12) United States Patent
Suzuki et al.

(10) Patent No.: US 10,962,267 B2
(45) Date of Patent: Mar. 30, 2021

(54) HEAT PUMP APPARATUS

(71) Applicant: Mitsubishi Electric Corporation, Tokyo (JP)

(72) Inventors: Yasuhiro Suzuki, Tokyo (JP); Hirokazu Minamisako, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 32 days.

(21) Appl. No.: 16/308,284

(22) PCT Filed: Sep. 8, 2016

(86) PCT No.: PCT/JP2016/076396
§ 371 (c)(1),
(2) Date: Dec. 7, 2018

(87) PCT Pub. No.: WO2018/047265
PCT Pub. Date: Mar. 15, 2018

(65) Prior Publication Data
US 2019/0264964 A1 Aug. 29, 2019

(51) Int. Cl.
*F25B 49/02* (2006.01)
*F24F 1/14* (2011.01)
(Continued)

(52) U.S. Cl.
CPC ..... *F25B 49/02* (2013.01); *F24F 1/14* (2013.01); *F24F 1/26* (2013.01); *F24H 4/02* (2013.01);
(Continued)

(58) Field of Classification Search
CPC . F24F 1/14; F24F 1/26; F24F 2140/10; F25B 25/005; F25B 47/025; F25B 2600/2525; F25B 30/02
See application file for complete search history.

(56) References Cited

U.S. PATENT DOCUMENTS 6,378,320 B1 * 4/2002 Matambo ..... F24F 1/22 361/807
9,273,889 B2 * 3/2016 Bernardi ..... F25B 49/005
(Continued)

FOREIGN PATENT DOCUMENTS

CN 101135474 A * 3/2008 ..... F25B 41/04
CN 101165412 A * 4/2008 ..... F25B 43/02
(Continued)

OTHER PUBLICATIONS

International Search Report of the International Searching Authority dated Nov. 29, 2016 for the corresponding international application No. PCT/JP2016/076396 (and English translation).
(Continued)

*Primary Examiner* — Nelson J Nieves
(74) *Attorney, Agent, or Firm* — Posz Law Group, PLC

(57) ABSTRACT

A heat pump apparatus includes: a refrigerant circuit configured to circulate refrigerant having flammability; a heat medium circuit configured to allow a heat medium to flow therethrough; a heat-medium heat exchanger configured to exchange heat between the refrigerant and the heat medium; an outdoor unit configured to accommodate the refrigerant circuit and the heat-medium heat exchanger; and an indoor unit configured to accommodate a part of the heat medium circuit, the outdoor unit including a refrigerant release valve, the refrigerant release valve being at least one of a pressure relief valve and an air purge valve which are provided in the heat medium circuit, the refrigerant release valve being provided outside a casing of the outdoor unit.

8 Claims, 4 Drawing Sheets

(51) Int. Cl.

| | |
|---|---|
| ***F24F 1/26*** | (2011.01) |
| ***F25B 30/02*** | (2006.01) |
| ***F25B 47/02*** | (2006.01) |
| ***F25B 25/00*** | (2006.01) |
| ***F24F 140/10*** | (2018.01) |
| ***F24H 4/02*** | (2006.01) |
| ***F24H 9/20*** | (2006.01) |

(52) U.S. Cl.
CPC ..... *F24H 9/2007* (2013.01); *F25B 25/005* (2013.01); *F25B 30/02* (2013.01); *F25B 47/025* (2013.01); *F24F 2140/10* (2018.01); *F25B 2339/047* (2013.01); *F25B 2400/12* (2013.01); *F25B 2600/2525* (2013.01)

(56) References Cited

U.S. PATENT DOCUMENTS

| | | | | |
|---|---|---|---|---|
| 2003/0056530 | A1* | 3/2003 | Rogstam | F25B 30/02 62/238.7 |
| 2009/0007578 | A1* | 1/2009 | Yabu | F24F 1/0003 62/190 |
| 2009/0241577 | A1* | 10/2009 | Fukushima | F25D 17/02 62/259.1 |
| 2014/0109611 | A1* | 4/2014 | Uchino | F25B 49/005 62/324.6 |
| 2015/0204599 | A1 | 7/2015 | Chisaki et al. | |
| 2017/0074564 | A1* | 3/2017 | Tashiro | F28F 1/32 |
| 2017/0211862 | A1* | 7/2017 | Slack | F25B 49/02 |
| 2018/0156217 | A1* | 6/2018 | Sakima | F25B 9/006 |

FOREIGN PATENT DOCUMENTS

| | | | | |
|---|---|---|---|---|
| CN | 202835659 | U | 3/2013 | |
| CN | 105674430 | A | 6/2016 | |
| FR | 2827948 | A1 * | 1/2003 | F25B 30/02 |
| FR | 3041420 | A1 * | 3/2017 | F28D 21/0012 |
| JP | S58-175735 | A | 10/1983 | |
| JP | 2000-039246 | A | 2/2000 | |
| JP | 2010-276229 | A | 12/2010 | |
| JP | 2011-064393 | A | 3/2011 | |
| JP | 2011-075276 | A | 4/2011 | |
| JP | 2013-047591 | A | 3/2013 | |
| JP | 2013-064538 | A | 4/2013 | |
| JP | 2013-167395 | A | 8/2013 | |
| JP | 2013-167398 | A | 8/2013 | |
| WO | WO-2007094349 | A1 * | 8/2007 | F24F 1/06 |
| WO | WO-2011117712 | A2 * | 9/2011 | F25B 30/02 |

OTHER PUBLICATIONS

Extended European Search Report dated Oct. 18, 2018 issued in corresponding EP patent application No. 16901904.9.
Partial Supplementary European Search Report dated Jul. 13, 2018 issued in corresponding EP patent application No. 16901904.9.
Office Action dated Apr. 12, 2019 issued in corresponding EP patent application No. 16 901 904.9.
Japanese Office Action dated Oct. 15, 2019 issued in corresponding JP patent application No. 2018-537929 (and English translation).
Office Action dated May 8, 2020 issued in corresponding CN patent application No. 201680088679.1 (and English translation).
Office Action dated Oct. 19, 2020 issued in corresponding CN patent application No. 201680088679.1 (and English translation).

* cited by examiner

HEAT PUMP APPARATUS

CROSS REFERENCE TO RELATED APPLICATION

This application is a U.S. national stage application of PCT/JP2016/076396 filed on Sep. 8, 2016, the contents of which are incorporated herein by reference.

TECHNICAL FIELD

The present invention relates to a heat pump apparatus including a refrigerant circuit and a heat medium circuit.

BACKGROUND ART

In Patent Literature 1, there is described an outdoor unit for a heat pump apparatus using flammable refrigerant. The outdoor unit includes a refrigerant circuit including a compressor, an air heat exchanger, an expansion device, and a water heat exchanger, which are connected to one another by pipes, and includes at least one of a pressure relief valve configured to prevent excessive rise of water pressure in a water circuit configured to supply water heated in the water heat exchanger, and an air purge valve configured to discharge air in the water circuit. With this configuration, even when a partition wall configured to partition the refrigerant circuit and the water circuit is broken in the water heat exchanger so that the flammable refrigerant is contaminated into the water circuit, the flammable refrigerant can be discharged to the outside through the pressure relief valve or the air purge valve.

CITATION LIST

Patent Literature

Patent Literature 1: Japanese Unexamined Patent Application Publication No. 2013-167398

SUMMARY OF INVENTION

Technical Problem

However, in Patent Literature 1, positions at which the pressure relief valve and the air purge valve which are provided in the outdoor unit are arranged are not mentioned. Therefore, there is a problem in that, for example, when an electrical spark occurs in electrical components in the outdoor unit, depending on the arrangement positions of the pressure relief valve and the air purge valve, the flammable refrigerant released through the pressure relief valve or the air purge valve may ignite.

The present invention has been made to overcome the problem described above, and has an object to provide a heat pump apparatus capable of further reliably preventing ignition of flammable refrigerant.

Solution to Problem

According to one embodiment of the present invention, there is provided a heat pump apparatus, including: a refrigerant circuit configured to circulate refrigerant having flammability; a heat medium circuit configured to allow a heat medium to flow therethrough; a heat-medium heat exchanger configured to exchange heat between the refrigerant and the heat medium; an outdoor unit configured to accommodate the refrigerant circuit and the heat-medium heat exchanger; and an indoor unit configured to accommodate a part of the heat medium circuit, the outdoor unit including a refrigerant release valve, the refrigerant release valve being at least one of a pressure relief valve and an air purge valve which are provided in the heat medium circuit, the refrigerant release valve being provided outside a casing of the outdoor unit.

Advantageous Effects of Invention

According to one embodiment of the present invention, even when the flammable refrigerant contaminated into the water circuit is released through the pressure relief valve or the air purge valve, the released refrigerant can be prevented from reaching an ignition source. Therefore, the ignition of the flammable refrigerant can further reliably be prevented.

DESCRIPTION OF EMBODIMENTS

Embodiment 1

Figure 1:
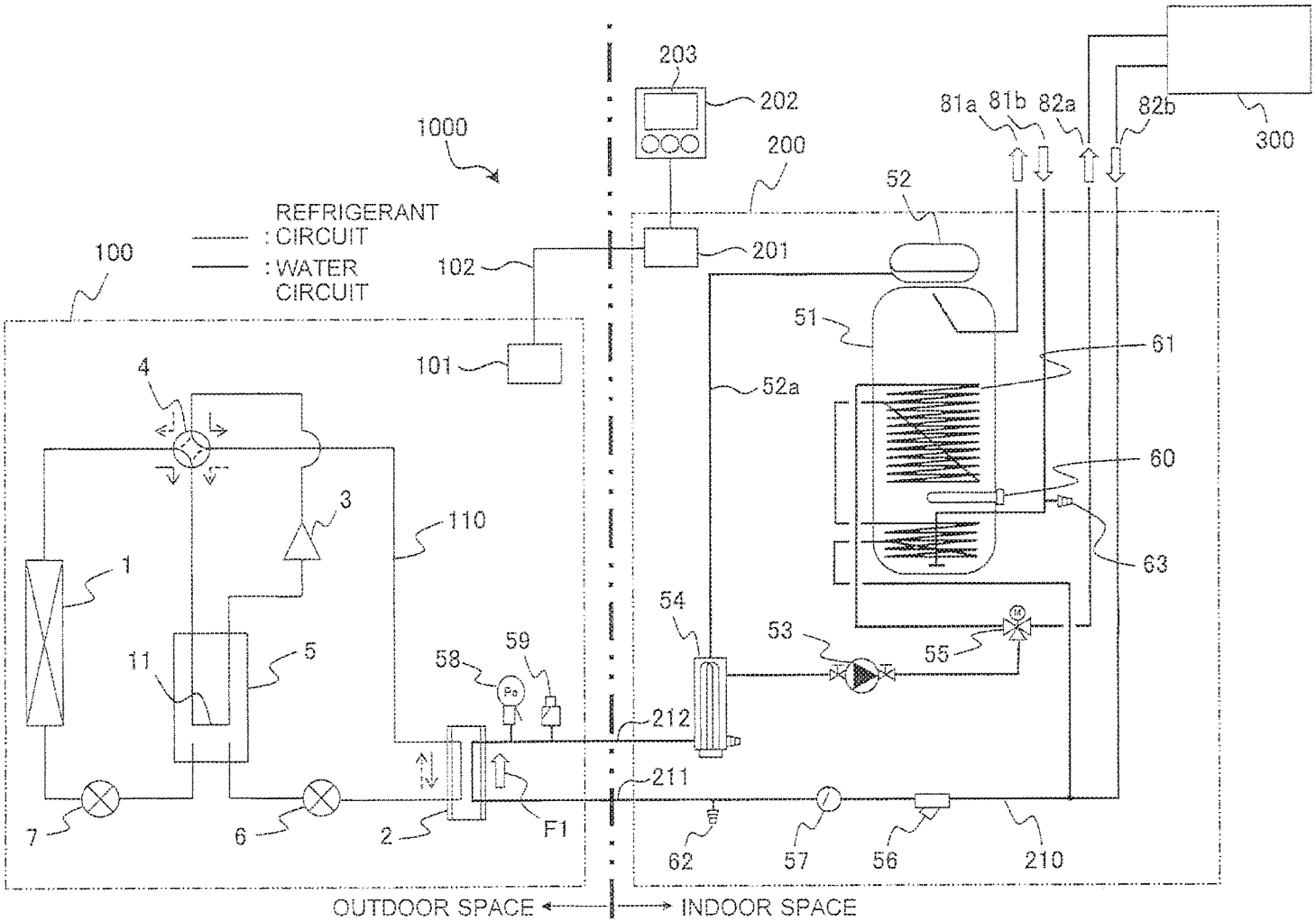
FIG. 1 is a circuit diagram for illustrating a schematic configuration of a heat pump apparatus according to Embodiment 1 of the present invention.

A heat pump apparatus according to Embodiment 1 of the present invention is described. FIG. 1 is a circuit diagram for illustrating a schematic configuration of the heat pump apparatus according to Embodiment 1. In Embodiment 1, a heat pump water heater 1000 is exemplified as the heat pump apparatus. In the drawings including FIG. 1 referred to below, a dimensional relationship of components and a shape of each of the components may be different from those of actual components.

As illustrated in FIG. 1, the heat pump water heater 1000 includes a refrigerant circuit 110 configured to circulate refrigerant and a water circuit 210 configured to allow water to flow therethrough. Further, the heat pump water heater 1000 includes an outdoor unit 100 installed outside, for example, outdoor space, and an indoor unit 200 installed indoor space. The indoor unit 200 is installed, for example, in a kitchen, a bathroom, or a laundry room, or, further, in a storage space such as a closet inside a building.

The refrigerant circuit 110 includes a compressor 3, a refrigerant flow switching device 4, a load-side heat exchanger 2, a first pressure reducing device 6, an intermediate pressure receiver 5, a second pressure reducing device 7, and a heat source-side heat exchanger 1, which are annularly connected in order through refrigerant pipes. Through use of the refrigerant circuit 110, the heat pump water heater 1000 is capable of a normal operation, for example, heater water heating operation, for heating water flowing through the water circuit 210 and a defrosting operation for circulating the refrigerant reversely to the normal operation to defrost the heat source-side heat exchanger 1.

The compressor 3 is a fluid machine configured to compress sucked low-pressure refrigerant and to discharge the low-pressure refrigerant as high-pressure refrigerant. The compressor 3 of Embodiment 1 includes an inverter device, and is configured to change a driving frequency freely selectively, to thereby be able to change a capacity, that is, an amount of the refrigerant to be sent per unit time.

The refrigerant flow switching device 4 is configured to switch a flow direction of the refrigerant inside the refrigerant circuit 110 between the normal operation and the defrosting operation. As the refrigerant flow switching device 4, for example, a four-way valve is used.

The load-side heat exchanger 2 is a water heat exchanger configured to exchange heat between the refrigerant flowing through the refrigerant circuit 110 and the water flowing through the water circuit 210. As the load-side heat exchanger 2, for example, a plate heat exchanger is used. The load-side heat exchanger 2 includes a refrigerant flow passage for allowing refrigerant to flow therethrough as a part of the refrigerant circuit 110, a water flow passage for allowing water to flow therethrough as a part of the water circuit 210, and a thin plate-like partition wall configured to partition the refrigerant flow passage and the water flow passage. The load-side heat exchanger 2 serves as a condenser (radiator) configured to heat water during the normal operation, and serves as an evaporator (heat absorber) during the defrosting operation.

The first pressure reducing device 6 is configured to adjust a flow rate of refrigerant, for example, adjust a pressure of the refrigerant flowing into the load-side heat exchanger 2. The intermediate pressure receiver 5 is located between the first pressure reducing device 6 and the second pressure reducing device 7 in the refrigerant circuit 110, and is configured to accumulate an excess of the refrigerant. A suction pipe 11 connected to a suction side of the compressor 3 passes through the inside of the intermediate pressure receiver 5. In the intermediate pressure receiver 5, heat is exchanged between the refrigerant passing through the suction pipe 11 and the refrigerant inside the intermediate pressure receiver 5. Therefore, the intermediate pressure receiver 5 has a function as an internal heat exchanger for the refrigerant circuit 110. The second pressure reducing device 7 is configured to adjust the pressure of the refrigerant by adjusting the flow rate of the refrigerant. The first pressure reducing device 6 and the second pressure reducing device 7 of Embodiment 1 are each an electronic expansion valve capable of changing an opening degree based on an instruction from a controller 101 described later.

The heat source-side heat exchanger 1 is an air heat exchanger configured to exchange heat between the refrigerant flowing through the refrigerant circuit 110 and outdoor air sent by an outdoor air-blowing fan or other devices (not shown). The heat source-side heat exchanger 1 serves as an evaporator (heat absorber) during the normal operation, and serves as a condenser (radiator) during the defrosting operation.

Examples of refrigerants used as the refrigerants to be circulated through the refrigerant circuit 110 include a slightly flammable refrigerant such as HFO-1234yf or HFO-1234ze(E) and a strongly flammable refrigerant such as R290 or R1270. Those refrigerants may be each used as a single-component refrigerant, or may be used as a contaminated refrigerant obtained by mixing two or more kinds of the refrigerants with each other. In the following description, the refrigerant having flammability equal to or higher than a slightly flammable level (for example, 2 L or higher in category of ASHRAE34) may be referred to as "refrigerant having flammability" or "flammable refrigerant". Those refrigerants have a density larger than air density under an atmospheric pressure (for example, with a temperature being a room temperature (25 degrees Celsius)).

The outdoor unit 100 accommodates the compressor 3, the refrigerant flow switching device 4, the load-side heat exchanger 2, the first pressure reducing device 6, the intermediate pressure receiver 5, the second pressure reducing device 7, and the heat source-side heat exchanger 1. That is, substantially all of the components of the refrigerant circuit 110 are accommodated in the outdoor unit 100.

Further, the outdoor unit 100 includes the controller 101 configured to mainly control an operation of the refrigerant circuit 110, for example, the compressor 3, the refrigerant flow switching device 4, the first pressure reducing device 6, the second pressure reducing device 7, and the outdoor air-blowing fan (not shown). The controller 101 includes a microcomputer including a CPU, a ROM, a RAM, and an I/O port. The controller 101 can communicate to/from a controller 201 and an operation unit 202, which are described later, through a control line 102.

Next, an example of the operation of the refrigerant circuit 110 is described. In FIG. 1, the flow direction of the refrigerant in the refrigerant circuit 110 during the normal operation is indicated by the solid arrows. The refrigerant circuit 110 is configured so that, during the normal operation, the refrigerant flow passage is switched by the refrigerant flow switching device 4 as indicated by the solid arrows to cause the high-temperature and high-pressure refrigerant to flow into the load-side heat exchanger 2.

The high-temperature and high-pressure gas refrigerant discharged from the compressor 3 passes through the refrigerant flow switching device 4, and flows into the refrigerant flow passage of the load-side heat exchanger 2. During the normal operation, the load-side heat exchanger 2 serves as a condenser. That is, in the load-side heat exchanger 2, heat is exchanged between the refrigerant flowing through the refrigerant flow passage and the water flowing through the water flow passage of the load-side heat exchanger 2, and the heat of condensation of the refrigerant is transferred to the water. With this operation, the refrigerant flowing through the refrigerant flow passage of the load-side heat exchanger 2 is condensed to become a high-pressure liquid refrigerant. Further, the water flowing through the water flow passage of the load-side heat exchanger 2 is heated by transfer heat from the refrigerant.

The high-pressure liquid refrigerant condensed by the load-side heat exchanger 2 flows into the first pressure reducing device 6, and is subjected to slight pressure reduction to become a two-phase refrigerant. The two-phase refrigerant flows into the intermediate pressure receiver 5, and is cooled by the heat exchange with a low-pressure gas refrigerant flowing through the suction pipe 11 to become a liquid refrigerant. The liquid refrigerant flows into the second pressure reducing device 7, and has the pressure reduced to become a low-pressure two-phase refrigerant. The low-pressure two-phase refrigerant flows into the heat source-side heat exchanger 1. During the normal operation, the heat source-side heat exchanger 1 serves as an evaporator. That is, in the heat source-side heat exchanger 1, heat is exchanged between the refrigerant circulated through the inside and the outdoor air sent by the outdoor air-blowing fan, and the heat of evaporation of the refrigerant is received from the outdoor air. With this operation, the refrigerant that has flowed into the heat source-side heat exchanger 1 evaporates to become the low-pressure gas refrigerant. The low-pressure gas refrigerant passes through the refrigerant flow switching device 4, and flows into the suction pipe 11. The low-pressure gas refrigerant that has flowed into the suction pipe 11 is heated by the heat exchange with the refrigerant inside the intermediate pressure receiver 5, and is sucked by the compressor 3. The refrigerant sucked by the compressor 3 is compressed to become the high-temperature and high-pressure gas refrigerant. In the normal operation, the above-mentioned cycle is continuously repeated.

Next, an example of the operation during the defrosting operation is described. In FIG. 1, the flow direction of the refrigerant in the refrigerant circuit 110 during the defrosting operation is indicated by the broken arrows. The refrigerant circuit 110 is configured so that, during the defrosting operation, the refrigerant flow passage is switched by the refrigerant flow switching device 4 as indicated by the broken arrows to cause the high-temperature and high-pressure refrigerant to flow into the heat source-side heat exchanger 1.

The high-temperature and high-pressure gas refrigerant discharged from the compressor 3 passes through the refrigerant flow switching device 4, and flows into the heat source-side heat exchanger 1. During the defrosting operation, the heat source-side heat exchanger 1 serves as a condenser. That is, in the heat source-side heat exchanger 1, the heat of condensation of the refrigerant circulated through the inside is transferred to frost adhering to a surface of the heat source-side heat exchanger 1. With this operation, the refrigerant circulated through the inside of the heat source-side heat exchanger 1 is condensed to become the high-pressure liquid refrigerant. Further, the frost adhering to the surface of the heat source-side heat exchanger 1 is melted by heat transfer from the refrigerant.

The high-pressure liquid refrigerant condensed by the heat source-side heat exchanger 1 passes through the second pressure reducing device 7, the intermediate pressure receiver 5, and the first pressure reducing device 6 to become the low-pressure two-phase refrigerant, and flows into the refrigerant flow passage of the load-side heat exchanger 2. The load-side heat exchanger 2 serves as an evaporator during the defrosting operation. That is, in the load-side heat exchanger 2, heat is exchanged between the refrigerant flowing through the refrigerant flow passage and the water flowing through the water flow passage, and heat of evaporation of the refrigerant is received from the water. With this operation, the refrigerant flowing through the refrigerant flow passage of the load-side heat exchanger 2 evaporates to become the low-pressure gas refrigerant. The gas refrigerant passes through the refrigerant flow switching device 4 and the suction pipe 11, and is sucked by the compressor 3. The refrigerant sucked by the compressor 3 is compressed to become the high-temperature and high-pressure gas refrigerant. In the defrosting operation, the above-mentioned cycle is continuously repeated.

Next, the water circuit 210 is described. The water circuit 210 includes a pump 53, a three-way valve 55, a hot-water storage tank 51, a strainer 56, a flow switch 57, the load-side heat exchanger 2, a pressure relief valve 58, an air purge valve 59, and a booster heater 54, which are connected to one another through water pipes. A drain outlet 62 configured to drain water inside the water circuit 210 is formed in a halfway part of the water pipes that constitute the water circuit 210.

Of the units of the water circuit 210, the load-side heat exchanger 2, the pressure relief valve 58, and the air purge valve 59 are provided in the outdoor unit 100. Of the units of the water circuit 210, units other than the load-side heat exchanger 2, the pressure relief valve 58, and the air purge valve 59 are provided in the indoor unit 200. That is, the water circuit 210 is provided across the outdoor unit 100 and the indoor unit 200. A part of the water circuit 210 is provided in the outdoor unit 100, and an other part of the water circuit 210 is provided in the indoor unit 200. The outdoor unit 100 and the indoor unit 200 are connected through two connecting pipes 211 and 212 being parts of the water pipes.

The hot-water storage tank 51 is a device configured to accumulate water in the inside. The hot-water storage tank 51 has a built-in coil 61 connected to the water circuit 210. The coil 61 is configured to exchange heat between the water (hot water) circulated through the water circuit 210 and the water accumulated inside the hot-water storage tank 51 to heat the water accumulated inside the hot-water storage tank 51. Further, the hot-water storage tank 51 has a built-in immersion heater 60. The immersion heater 60 is a heating unit configured to further heat the water accumulated inside the hot-water storage tank 51.

The water inside the hot-water storage tank 51 flows into a sanitary circuit-side pipe 81*a* (supply pipe) connected to, for example, a shower. Further, a drain outlet 63 is also formed in a sanitary circuit-side pipe 81*b* (return pipe). In this case, in order to prevent the water accumulated inside the hot-water storage tank 51 from being cooled by the outside air, the hot-water storage tank 51 is covered with a heat insulating material (not shown). Examples of the heat insulating material to be used include felt, Thinsulate (trademark), and a vacuum insulation panel (VIP).

The pump 53 is a device configured to apply pressure to the water inside the water circuit 210 to circulate the water through the inside of the water circuit 210. The booster heater 54 is a device configured to further heat the water inside the water circuit 210 when, for example, the outdoor unit 100 has insufficient heating capacity. The three-way valve 55 is a device configured to cause the water inside the water circuit 210 to branch off. For example, the three-way valve 55 is configured to switch a destination to which the water inside the water circuit 210 is to be caused to flow between to the hot-water storage tank 51 and to a heater circuit-side pipe 82*a* (supply pipe) connected to a heater 300 such as a radiator or a floor heater, which is provided to the outside. Here, the heater circuit-side pipe 82*a* (supply pipe) and a heater circuit-side pipe 82*b* (return pipe) are pipes for circulating the water between the water circuit 210 in the indoor unit 200 and the heater 300. The strainer 56 is a device configured to remove scale (sediment) inside the water circuit 210. The flow switch 57 is a device configured to detect whether or not the flow rate of the water circulated through the inside of the water circuit 210 is equal to or larger than a fixed amount.

An expansion tank 52 is a device configured to control the pressure changed due to a volume change of the water inside the water circuit 210 involved in the heating or other operations within a fixed range. The expansion tank 52 of Embodiment 1 is connected to the booster heater 54 through a pipe 52*a*.

In the outdoor unit 100, the pressure relief valve 58 is provided downstream of the load-side heat exchanger 2 in a flow direction of water inside the water circuit 210 (the arrow F1 in FIG. 1). The pressure relief valve 58 is a protection device configured to prevent excessive rise of the pressure inside the water circuit 210. When the pressure in the water circuit 210 is increased to exceed the pressure control range of the expansion tank 52, the water inside the water circuit 210 is released to the outside through the pressure relief valve 58.

In the outdoor unit 100, the air purge valve 59 is provided downstream of the load-side heat exchanger 2 in the flow direction of water inside the water circuit 210. In Embodiment 1, the air purge valve 59 is provided further downstream of the pressure relief valve 58 in the flow direction of water inside the water circuit 210. However, the air purge valve 59 is not limited thereto. The air purge valve 59 is a device configured to release, to the outside, gas generated in the water circuit 210 and the gas contaminated into the water circuit 210, and to prevent the idle running (air entrainment) of the pump 53. As the air purge valve 59, for example, an automatic air purge valve of a float type is used.

In Embodiment 1, water is given as an example of a heat medium circulated through the water circuit 210. However, as the heat medium, other liquid heat media such as brine may be used.

The indoor unit 200 includes the controller 201 configured to mainly control an operation of the water circuit 210, for example, the pump 53, the booster heater 54, and the three-way valve 55. The control unit 201 includes a microcomputer including a CPU, a ROM, a RAM, and an I/O port. The controller 201 can mutually communicate with the controller 101 and the operation unit 202.

The operation unit 202 allows a user to conduct the operation or various settings of the heat pump water heater 1000. The operation unit 202 of Embodiment 1 includes a display unit 203. The display unit 203 can display various kinds of information including a state of the heat pump water heater 1000. The operation unit 202 is provided, for example, on a casing of the indoor unit 200.

Figure 2:
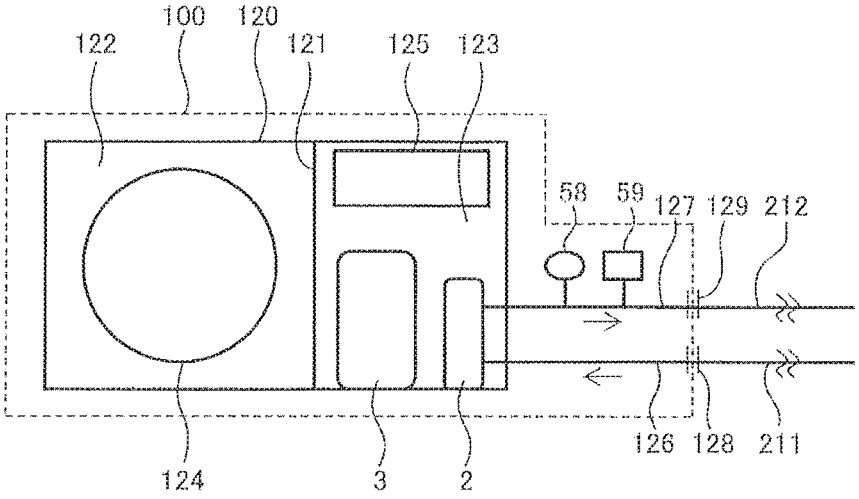
FIG. 2 is a schematic diagram for illustrating a configuration of an outdoor unit 100 of the heat pump apparatus according to Embodiment 1 of the present invention.

FIG. 2 is a schematic diagram for illustrating a configuration of the outdoor unit 100 of the heat pump apparatus according to Embodiment 1. As illustrated in FIG. 2, the outdoor unit 100 includes a casing 120. The casing 120 is made of, for example, metal. In the casing 120, there are accommodated the compressor 3, the load-side heat exchanger 2, the heat source-side heat exchanger 1 (not shown in FIG. 2), an outdoor air-blowing fan 124, electrical components configured to operate those units, and other components. A space inside the casing 120 is partitioned by a partition plate 121 into an air-blowing fan chamber 122 and a machine chamber 123. The partition plate 121 is made of, for example, metal.

In the air-blowing fan chamber 122, there are provided the heat source-side heat exchanger 1 (not shown in FIG. 2) being an air heat exchanger, and the outdoor air-blowing fan 124 configured to supply outdoor air to the heat source-side heat exchanger 1. The outdoor air-blowing fan 124 includes an impeller and a motor configured to drive the impeller.

In the machine chamber 123, there are provided units constituting the refrigerant circuit 110, such as the compressor 3 and the load-side heat exchanger 2, and an electrical component box 125 configured to accommodate the electrical components. The electrical components include a control board constituting the controller 101, and a relay configured to switch supply and interruption of power to the compressor 3 and the outdoor air-blowing fan 124.

Outdoor-unit pipes 126 and 127 being parts of the water pipes of the water circuit 210 are connected to the load-side heat exchanger 2. The outdoor-unit pipe 126 is a water pipe provided upstream of the load-side heat exchanger 2 in the flow direction of the water, and the outdoor-unit pipe 127 is a water pipe provided downstream of the load-side heat exchanger 2 in the flow direction of the water. The outdoor-unit pipes 126 and 127 pass through the casing 120 to protrude out of the casing 120. Joint portions 128 and 129 are provided on distal end portions of the outdoor-unit pipes 126 and 127, respectively, at portions on the outside of the casing 120. The outdoor-unit pipes 126 and 127 are connected to the connecting pipes 211 and 212 through intermediation of the joint portions 128 and 129, respectively. The pressure relief valve 58 and the air purge valve 59 are provided on the outdoor-unit pipe 127 at portions on the outside of the casing 120. That is, the pressure relief valve 58 and the air purge valve 59 are provided outside the casing 120 in the outdoor unit 100, and provided downstream of the load-side heat exchanger 2 in the flow direction of the water.

Next, description is made of an operation in a case where the partition wall configured to partition the refrigerant flow passage and the water flow passage in the load-side heat exchanger 2 is broken. The load-side heat exchanger 2 serves as an evaporator during the defrosting operation. Therefore, the partition wall of the load-side heat exchanger 2 may be broken due to freezing of water or other causes particularly during the defrosting operation. In general, the pressure of the refrigerant flowing through the refrigerant flow passage of the load-side heat exchanger 2 is higher than the pressure of the water flowing through the water flow passage of the load-side heat exchanger 2 both during the normal operation and during the defrosting operation. Therefore, when the partition wall of the load-side heat exchanger 2 is broken, the refrigerant in the refrigerant flow passage flows out to the water flow passage both during the normal operation and during the defrosting operation, and the refrigerant is contaminated into the water inside the water flow passage. At this time, the refrigerant contaminated into the water is gasified due to pressure decrease. Further, the refrigerant having the pressure higher than that of the water is contaminated into the water, with the result that the pressure in the water flow passage is increased.

In Embodiment 1, the pressure relief valve 58 and the air purge valve 59 are provided outside the casing 120 in the outdoor unit 100. Therefore, when the pressure in the water circuit 210 is increased due to the contaminating refrigerant, the refrigerant contaminated into the water is released to the atmosphere in the outside space on the outside of the casing 120 together with the water by the pressure relief valve 58. Alternatively, the refrigerant in a gas state, which is contaminated into the water, is released to the atmosphere in the outside space on the outside of the casing 120 by the air purge valve 59. As described above, the refrigerant contaminated into the water inside the water circuit 210 may be released to the outside by both of the pressure relief valve 58 and the air purge valve 59. That is, both of the pressure relief valve 58 and the air purge valve 59 function as refrigerant release valves configured to release the refrigerant contaminated into the water inside the water circuit 210 to the outside. Therefore, both of the pressure relief valve 58 and the air purge valve 59 may be provided outside the casing 120 in the outdoor unit 100, or only one of the pressure relief valve 58 and the air purge valve 59 may be provided outside the casing 120 in the outdoor unit 100.

Further, in Embodiment 1, at least one of the pressure relief valve 58 and the air purge valve 59 is provided downstream of the load-side heat exchanger 2 and upstream of the indoor unit 200 in the flow direction of the water.

Therefore, the refrigerant contaminated into the water in the load-side heat exchanger 2 is released to the atmosphere in the outside space by the pressure relief valve 58 or the air purge valve 59 before the refrigerant flows into the indoor unit 200.

As described above, the heat pump apparatus according to Embodiment 1 includes the refrigerant circuit 110 configured to circulate the refrigerant having flammability, the water circuit 210 (example of the heat medium circuit) configured to allow the water (example of the heat medium) to flow therethrough, the load-side heat exchanger 2 (example of the heat-medium heat exchanger) configured to exchange heat between the refrigerant and the water, the outdoor unit 100 configured to accommodate the refrigerant circuit 110 and the load-side heat exchanger 2, and the indoor unit 200 configured to accommodate a part of the water circuit 210. The outdoor unit 100 includes at least one of the pressure relief valve 58 and the air purge valve 59 provided in the water circuit 210 as the refrigerant release valve that may release the refrigerant contaminated into the water circuit 210 to the outside. The refrigerant release valve of the outdoor unit 100 is provided outside the casing 120 of the outdoor unit 100.

According to this configuration, the refrigerant contaminated into the water circuit 210 in the load-side heat exchanger 2 can be released to the atmosphere in the outside space being the outside of the casing 120 of the outdoor unit 100. Therefore, even when the refrigerant contaminated into the water circuit 210 is released through the pressure relief valve 58 or the air purge valve 59, the released refrigerant can be prevented from reaching the electrical components inside the casing 120 that may be an ignition source. Therefore, ignition of the refrigerant due to an electrical spark or other causes which may occur in the electrical components inside the casing 120 can further reliably be prevented.

Further, in the heat pump apparatus according to Embodiment 1, the refrigerant release valve of the outdoor unit 100 is provided downstream of the load-side heat exchanger 2 in the flow direction of the water.

According to this configuration, the refrigerant contaminated into the water circuit 210 in the load-side heat exchanger 2 can be released to the atmosphere in the outside space before the refrigerant flows into the indoor unit 200. Therefore, even when the pressure relief valve or the air purge valve is also provided in the indoor unit 200, the refrigerant can be prevented from being released to the indoor space by the pressure relief valve or the air purge valve of the indoor unit 200.

Further, in Embodiment 1, the joint portions 128 and 129 are provided so as to be protruded from the casing 120 together with the outdoor-unit pipes 126 and 127. Therefore, in Embodiment 1, as compared to a configuration in which the joint portions 128 and 129 are provided inside the casing 120 or on a surface of the casing 120, a space inside the casing 120 of the outdoor unit 100 can have a spatial allowance. Therefore, the layout design inside the casing 120 is facilitated. Further, in Embodiment 1, as compared to the configuration in which the joint portions 128 and 129 are provided inside the casing 120 or on the surface of the casing 120, the installation performance when the outdoor unit 100 is connected to the connecting pipes 211 and 212 is enhanced.

Embodiment 2

Figure 3:
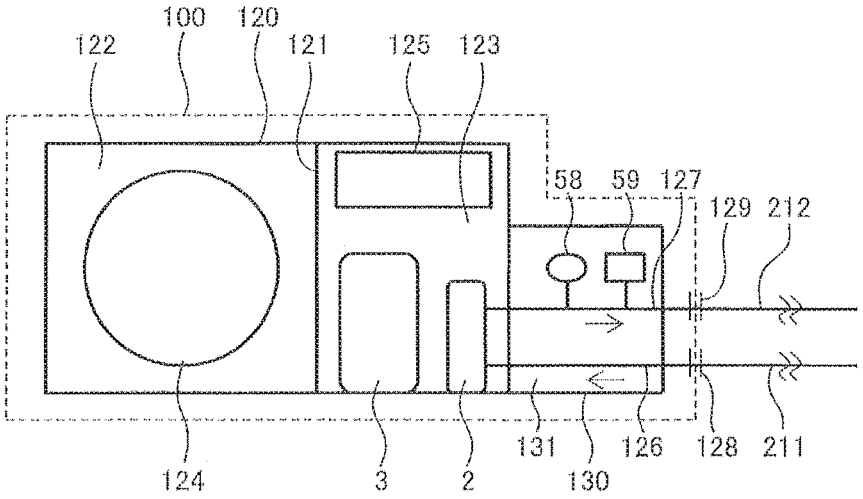
FIG. 3 is a schematic diagram for illustrating a configuration of an outdoor unit 100 of a heat pump apparatus according to Embodiment 2 of the present invention.

A heat pump apparatus according to Embodiment 2 of the present invention is described. FIG. 3 is a schematic diagram for illustrating a configuration of the outdoor unit 100 of the heat pump apparatus according to Embodiment 2. Components having the same functions and actions as those of Embodiment 1 are denoted by the same reference symbols, and description thereof is omitted.

As illustrated in FIG. 3, a valve chamber 131 covered with a cover 130 made of, for example, a resin is formed outside the casing 120. The valve chamber 131 is formed outside the casing 120. Therefore, the valve chamber 131 is partitioned from both of the air-blowing fan chamber 122 and the machine chamber 123 inside the casing 120. In the outdoor unit 100, there are formed the air-blowing fan chamber 122 and the machine chamber 123 provided inside the casing 120, and the valve chamber 131 provided outside the casing 120.

The pressure relief valve 58 and the air purge valve 59 are provided in the valve chamber 131. In the valve chamber 131, for example, only the pressure relief valve 58, the air purge valve 59, and the outdoor-unit pipes 126 and 127 are accommodated. The valve chamber 131 is communicated to the outside space through an opening portion (not shown) formed in the cover 130.

Figure 4:
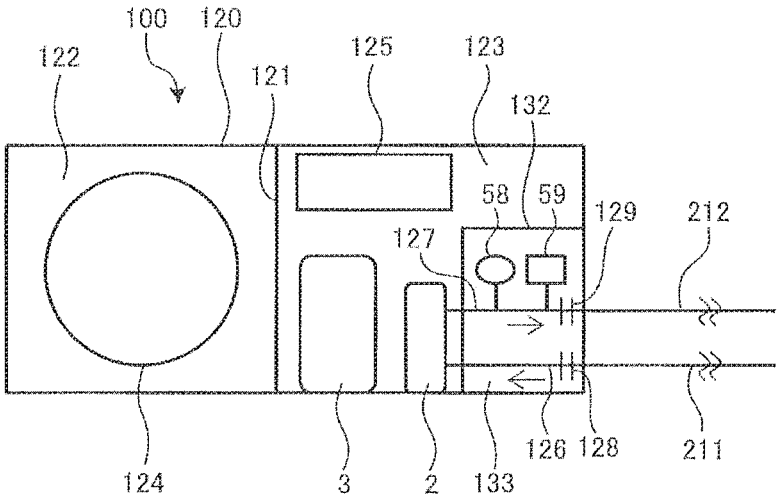
FIG. 4 is a schematic diagram for illustrating a configuration of an outdoor unit 100 of a heat pump apparatus of a modification example of Embodiment 2 of the present invention.

FIG. 4 is a schematic diagram for illustrating a configuration of the outdoor unit 100 of the heat pump apparatus of a modification example of Embodiment 2. As illustrated in FIG. 4, in the inside of the casing 120, there are provided the partition plate 121 configured to partition the air-blowing fan chamber 122 and the machine chamber 123, and a partition plate 132 configured to partition the machine chamber 123 and a valve chamber 133. That is, the space inside the casing 120 is partitioned by the partition plates 121 and 132 into the air-blowing fan chamber 122, the machine chamber 123, and the valve chamber 133. Both of the partition plates 121 and 132 are made of, for example, metal. In this modification example, the valve chamber 133 is formed by the partition plate 132 in place of the cover 130 illustrated in FIG. 3.

The pressure relief valve 58 and the air purge valve 59 are provided in the valve chamber 133. In the valve chamber 133, for example, only the pressure relief valve 58, the air purge valve 59, and the outdoor-unit pipes 126 and 127 are accommodated. The valve chamber 133 is communicated to the outside space through an opening portion (not shown) formed in the casing 120.

Further, in this modification example, the joint portions 128 and 129 are provided inside the casing 120 or on the surface of the casing 120. With this configuration, in this modification example, as compared to the configuration in which the joint portions 128 and 129 are protruded from the casing 120 together with the outdoor-unit pipes 126 and 127, the design of the outdoor unit 100 can be enhanced.

As described above, the heat pump apparatus according to Embodiment 2 includes the refrigerant circuit 110 configured to circulate the refrigerant having flammability, the water circuit 210 (example of the heat medium circuit) configured to allow the water (example of the heat medium) to flow therethrough, the load-side heat exchanger 2 (example of the heat-medium heat exchanger) configured to exchange heat between the refrigerant and the water, the outdoor unit 100 configured to accommodate the refrigerant circuit 110 and the load-side heat exchanger 2, and the indoor unit 200 configured to accommodate a part of the water circuit 210. The outdoor unit 100 includes at least one of the pressure relief valve 58 and the air purge valve 59 provided in the water circuit 210 as the refrigerant release valve. The outdoor unit 100 has at least both of a first chamber, for example, the machine chamber 123, in which the electrical components are provided, and a second chamber, for example, the valve chamber 131 or 133, which is partitioned from the first chamber. The refrigerant release valve of the outdoor unit 100 is provided in the second chamber.

According to this configuration, the refrigerant contaminated into the water circuit 210 in the load-side heat exchanger 2 can be released to the second chamber partitioned from the first chamber in which the electrical components are provided. Therefore, even when the refrigerant contaminated into the water circuit 210 is released through the pressure relief valve 58 or the air purge valve 59, the ignition of the refrigerant due to an electrical spark or other causes which may occur in the electrical components can further reliably be prevented.

Further, according to this configuration, the refrigerant release valve of the outdoor unit 100 is provided in the second chamber. Thus, the refrigerant release valve can be prevented from getting wet in the rain and being corroded.

Embodiment 3

Figure 5:
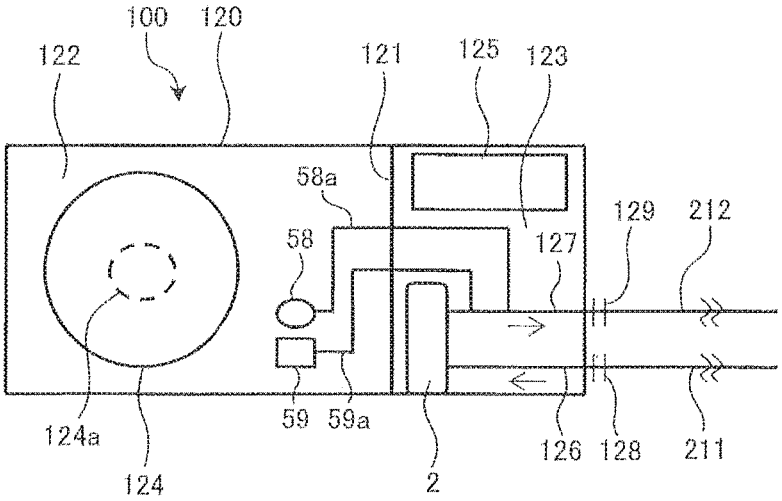
FIG. 5 is a schematic diagram for illustrating a configuration of an outdoor unit 100 of a heat pump apparatus according to Embodiment 3 of the present invention.

A heat pump apparatus according to Embodiment 3 of the present invention is described. FIG. 5 is a schematic diagram for illustrating a configuration of the outdoor unit 100 of the heat pump apparatus according to Embodiment 3. Components having the same functions and actions as those of Embodiment 1 or Embodiment 2 are denoted by the same reference symbols, and description thereof is omitted.

As illustrated in FIG. 5, the space inside the casing 120 is partitioned by the partition plate 121 into the air-blowing fan chamber 122 and the machine chamber 123. That is, in Embodiment 3, the valve chamber is not provided. In the machine chamber 123, there are provided the compressor 3 (not shown in FIG. 5) and the load-side heat exchanger 2, which constitute the refrigerant circuit 110, the outdoor-unit pipes 126 and 127, and the electrical component box 125.

In the air-blowing fan chamber 122, there are provided the heat source-side heat exchanger 1 (not shown in FIG. 5), the outdoor air-blowing fan 124 configured to blow outdoor air to the heat source-side heat exchanger 1, the pressure relief valve 58, and the air purge valve 59. Through a conduit pipe 58*a* passing through the partition plate 121, the pressure relief valve 58 is connected to the outdoor-unit pipe 127 provided in the machine chamber 123. Through a conduit pipe 59*a* passing through the partition plate 121, the air purge valve 59 is connected to the outdoor-unit pipe 127 provided in the machine chamber 123. As a motor 124*a* of the outdoor air-blowing fan 124, a brushless motor, for example, a DC brushless motor or an induction motor is used.

As described above, the heat pump apparatus according to Embodiment 3 includes the refrigerant circuit 110 configured to circulate the refrigerant having flammability, the water circuit 210 (example of the heat medium circuit) configured to allow the water (example of the heat medium) to flow therethrough, the load-side heat exchanger 2 (example of the heat-medium heat exchanger) configured to exchange heat between the refrigerant and the water, the outdoor unit 100 configured to accommodate the refrigerant circuit 110 and the load-side heat exchanger 2, and the indoor unit 200 configured to accommodate a part of the water circuit 210. The outdoor unit 100 includes at least one of the pressure relief valve 58 and the air purge valve 59 provided in the water circuit 210 as the refrigerant release valve. The outdoor unit 100 has at least both of the first chamber, for example, the machine chamber 123, in which the electrical components are provided, and the second chamber, for example, the air-blowing fan chamber 122, which is partitioned from the first chamber. The refrigerant release valve of the outdoor unit 100 is provided in the second chamber.

According to this configuration, the refrigerant contaminated into the water circuit 210 in the load-side heat exchanger 2 can be released to the second chamber partitioned from the first chamber in which the electrical components are provided. Therefore, even when the refrigerant contaminated into the water circuit 210 is released through the pressure relief valve 58 or the air purge valve 59, the ignition of the refrigerant due to an electrical spark or other causes which may occur in the electrical components can further reliably be prevented.

Further, according to this configuration, the refrigerant release valve of the outdoor unit 100 is provided in the second chamber. Thus, the refrigerant release valve can be prevented from getting wet in the rain and being corroded.

Further, the heat pump apparatus according to Embodiment 3 further includes the heat source-side heat exchanger 1 configured to exchange heat between the refrigerant and the outdoor air, and the outdoor air-blowing fan 124 configured to blow the outdoor air to the heat source-side heat exchanger 1. The outdoor air-blowing fan 124 is provided in the second chamber.

According to this configuration, when the outdoor air-blowing fan 124 is operated, the refrigerant released to the second chamber can be rapidly diffused to the outside space by the outdoor air-blowing fan 124.

Further, in the heat pump apparatus according to Embodiment 3, the outdoor air-blowing fan 124 includes the brushless motor 124*a*.

According to this configuration, with the use of the motor 124*a* of the outdoor air-blowing fan 124, occurrence of an electrical spark can be prevented. Thus, the ignition of the refrigerant released to the second chamber can further reliably be prevented.

Embodiment 4

Figure 6:
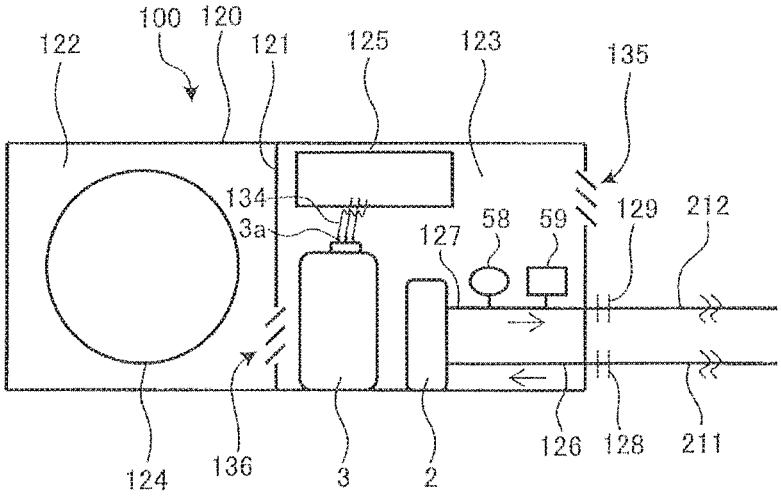
FIG. 6 is a schematic diagram for illustrating a configuration of an outdoor unit 100 of a heat pump apparatus according to Embodiment 4 of the present invention.

A heat pump apparatus according to Embodiment 4 of the present invention is described. FIG. 6 is a schematic diagram for illustrating a configuration of the outdoor unit 100 of the heat pump apparatus according to Embodiment 4. Components having the same functions and actions as those of Embodiment 1, Embodiment 2, or Embodiment 3 are denoted by the same reference symbols, and description thereof is omitted. Further, positional relationships, for example, top-bottom relationships between respective components in Embodiment 4 are, in principle, positional relationships exhibited when the heat pump apparatus is installed in a usable state.

As illustrated in FIG. 6, the space inside the casing 120 is partitioned by the partition plate 121 into the air-blowing fan chamber 122 and the machine chamber 123. In the machine chamber 123, there are provided the compressor 3 and the load-side heat exchanger 2, which constitute the refrigerant circuit 110, the outdoor-unit pipes 126 and 127, the electrical component box 125, the pressure relief valve 58, and the air purge valve 59. In the electrical component box 125, electrical components such as the relay are accommodated. The electrical components in the electrical component box 125, for example, the relay is connected through an electric wire 134 to a terminal 3*a* provided in a terminal block of the compressor 3. The pressure relief valve 58 and the air purge valve 59 are provided below the electrical components in the electrical component box 125, such as the relay, and are provided, for example, below a lower end portion of the electrical component box 125. Further, the pressure relief valve 58 and the air purge valve 59 are provided below the terminal 3*a* of the compressor 3. In this case, height positions of the pressure relief valve 58 and the air purge valve 59 can be defined by height positions of respective release ports of the pressure relief valve 58 and the air purge valve 59.

In the machine chamber 123, there are formed a first ventilation port 135 configured to circulate air between the machine chamber 123 and the outside of the casing 120, and a second ventilation port 136 configured to circulate air between the machine chamber 123 and the air-blowing fan chamber 122. The first ventilation port 135 is formed above the pressure relief valve 58 and the air purge valve 59. The second ventilation port 136 is formed below the pressure relief valve 58 and the air purge valve 59. A louver is formed on each of the first ventilation port 135 and the second ventilation port 136.

In Embodiment 4, the first ventilation port 135 is formed in a side wall of the casing 120 so as to circulate air between the machine chamber 123 and the outside of the casing 120. Further, the second ventilation port 136 is formed in the partition plate 121 so as to circulate air between the machine chamber 123 and the air-blowing fan chamber 122. However, both of the first ventilation port 135 and the second ventilation port 136 may be formed in the partition plate 121, or may be formed in the casing 120. Further, the first ventilation port 135 and the second ventilation port 136 may be formed in the same side wall of the casing 120.

As described above, the heat pump apparatus according to Embodiment 4 includes the refrigerant circuit 110 configured to circulate the refrigerant having flammability, the water circuit 210 (example of the heat medium circuit) configured to allow the water (example of the heat medium) to flow therethrough, the load-side heat exchanger 2 (example of the heat-medium heat exchanger) configured to exchange heat between the refrigerant and the water, the outdoor unit 100 configured to accommodate the refrigerant circuit 110 and the load-side heat exchanger 2, and the indoor unit 200 configured to accommodate a part of the water circuit 210. The outdoor unit 100 includes at least one of the pressure relief valve 58 and the air purge valve 59 provided in the water circuit 210 as the refrigerant release valve. The outdoor unit 100 has at least the first chamber, for example, the machine chamber 123, in which the electrical components are provided. The refrigerant release valve of the outdoor unit 100 is provided in the first chamber at a position below the electrical components. In the first chamber, there are formed the first ventilation port 135 formed above the refrigerant release valve, and the second ventilation port 136 formed below the refrigerant release valve.

The refrigerant used in Embodiment 4 has a density larger than that of air under the atmospheric pressure. Thus, the refrigerant released to the machine chamber 123 by the pressure relief valve 58 or the air purge valve 59 flows down. In Embodiment 4, the refrigerant release valves, for example, the pressure relief valve 58 and the air purge valve 59 are provided below the electrical components, for example, the relay being an electrical contact component. Therefore, the refrigerant released to the machine chamber 123 by the pressure relief valve 58 or the air purge valve 59 can be prevented from reaching the ignition source.

Further, in Embodiment 4, the first ventilation port 135 formed above the refrigerant release valve and the second ventilation port 136 formed below the refrigerant release valve are formed in the machine chamber 123. Therefore, when the refrigerant is released to the machine chamber 123 by the pressure relief valve 58 or the air purge valve 59, through natural convection that may occur due to a difference in density between the refrigerant and the air, the outside air flows into the machine chamber 123 through the first ventilation port 135, and the refrigerant inside the machine chamber 123 flows out to the outside through the second ventilation port 136. With this operation, the refrigerant released to the machine chamber 123 is discharged to the outside through the second ventilation port 136 without stagnating inside the machine chamber 123. Therefore, formation of a flammable region inside the machine chamber 123 can be prevented. When refrigerant having a density smaller than that of air under the atmospheric pressure is used, the refrigerant released to the machine chamber 123 is released to the outside through the first ventilation port 135 along a flow direction reverse to that in the above-mentioned case. Therefore, even when the refrigerant having a density smaller than that of air under the atmospheric pressure is used, the formation of the flammable region inside the machine chamber 123 can be prevented.

As described above, in Embodiment 4, even when the refrigerant is released to the inside of the machine chamber 123 by the pressure relief valve 58 or the air purge valve 59, the formation of the flammable region inside the machine chamber 123 can be prevented, and further, the refrigerant released to the machine chamber 123 can be prevented from reaching the ignition source. Therefore, even when the refrigerant is contaminated into the water circuit 210 in the load-side heat exchanger 2, the ignition of the refrigerant can further reliably be prevented.

Further, in Embodiment 4, the refrigerant release valve of the outdoor unit 100 is provided in the machine chamber 123. Thus, the refrigerant release valve can be prevented from getting wet in the rain and being corroded.

Further, in Embodiment 4, the relay which may be the ignition source is accommodated in the electrical component box 125. Thus, the refrigerant released to the first chamber and the ignition source can further reliably be separated from each other so that the ignition of the refrigerant can further reliably be avoided.

The present invention is not limited to the above-mentioned embodiments, and various modifications may be made thereto.

For example, in the above-mentioned embodiments, the plate heat exchanger is given as an example of the load-side heat exchanger 2. However, the load-side heat exchanger 2 may be a heat exchanger other than the plate heat exchanger, such as a double-pipe heat exchanger as long as the heat exchanger is configured to exchange heat between refrigerant and a heat medium.

Further, in the above-mentioned embodiments, the heat pump water heater 1000 is given as an example of the heat pump apparatus. However, the present invention is also applicable to other heat pump apparatus, such as a chiller.

Further, in the above-mentioned embodiments, the configuration in which the pressure relief valve and the air purge valve are not provided in the indoor unit 200 is given as an example. However, at least one of the pressure relief valve and the air purge valve may be provided in the indoor unit 200 or a use-side circuit other than the indoor unit 200, for example, the sanitary circuit-side pipe 81*a* or 81*b*, the heater circuit-side pipe 82*a* or 82*b*, or the heater 300.

Further, in the above-mentioned embodiments, the indoor unit 200 including the hot-water storage tank 51 is given as an example. However, the hot-water storage tank may be provided separately from the indoor unit 200.

Further, the embodiments described above may be carried out in combinations.

REFERENCE SIGNS LIST

1 heat source-side heat exchanger 2 load-side heat exchanger compressor 3*a* terminal 4 refrigerant flow switching device 5 intermediate pressure receiver 6 first pressure reducing device 7 second pressure reducing device 11 suction pipe 51 hot-water storage tank 52 expansion tank 52*a* pipe 53 pump 54 booster heater 55 three-way valve 56 strainer 57 flow switch 58 pressure relief valve 58*a* conduit pipe 59 air purge valve 59*a* conduit pipe 60 immersion heater 61 coil 62, 63 drain outlet 81*a*, 81*b* sanitary circuit-side pipe 82*a*, 82*b* heater circuit-side pipe

100 outdoor unit 101 controller 102 control line 110 refrigerant circuit 120 casing 121 partition plate 122 air-blowing fan chamber 123 machine chamber 124 outdoor air-blowing fan 124*a* motor 125 electrical component box 126, 127 outdoor-unit pipe 128, 129 joint portion 130 cover 131 valve chamber 132 partition plate 133 valve chamber

134 electric wire 135 first ventilation port 136 second ventilation port

200 indoor unit 201 controller 202 operation unit 203 display unit 210 water circuit 211, 212 connecting pipe 300 heater 1000 heat pump water heater

The invention claimed is:

1. A heat pump apparatus comprising:

a refrigerant circuit configured to circulate refrigerant having flammability;

a heat medium circuit configured to allow a heat medium to flow therethrough;

a heat-medium heat exchanger configured to exchange heat between the refrigerant and the heat medium;

an outdoor unit housing the refrigerant circuit and the heat-medium heat exchanger, the outdoor unit having at least a first chamber and a second chamber partitioned from the first chamber;

an indoor unit housing a part of the heat medium circuit, the first chamber of the outdoor unit comprising a compressor of the refrigerant circuit, and the second chamber of the outdoor unit comprising a refrigerant release valve configured to release refrigerant contaminated into the heat medium, the refrigerant release valve being at least one of a pressure relief valve and an air purge valve which are provided in the heat medium circuit, and an air-blowing fan configured to blow outdoor air toward an air heat exchanger.

2. The heat pump apparatus of claim 1, wherein the air heat exchanger is provided in the second chamber and configured to exchange heat between the refrigerant and the outdoor air.

3. The heat pump apparatus of claim 1, wherein the air-blowing fan comprises a brushless motor.

4. The heat pump apparatus of claim 1, wherein the refrigerant release valve is provided downstream of the heat-medium heat exchanger in a flow direction of the heat medium.

5. The heat pump apparatus of claim 1, wherein the refrigerant release valve includes the pressure relief valve.

6. The heat pump apparatus of claim 1, wherein the second chamber containing the refrigerant release valve has an opening communicating with outside space.

7. A heat pump apparatus comprising:

a refrigerant circuit configured to circulate refrigerant having flammability;

a heat medium circuit configured to allow a heat medium to flow therethrough;

a heat-medium heat exchanger configured to exchange heat between the refrigerant and the heat medium;

an outdoor unit configured to accommodate the refrigerant circuit and a part of the heat-medium heat exchanger; and an indoor unit configured to accommodate another part of the heat medium circuit, the refrigerant having a density larger than air density under an atmospheric pressure, the part of the heat medium circuit accommodated in the outdoor unit comprising a refrigerant release valve including at least one of a pressure relief valve and an air purge valve which are provided in the heat medium circuit as a refrigerant release valve and configured to release refrigerant contaminated into the heat medium, the outdoor unit having at least a first chamber in which an electrical component configured to cause the refrigerant circuit to operate is provided, the refrigerant release valve being provided in the first chamber at a position below the electrical component, the first chamber having a first ventilation port formed above the refrigerant release valve, and a second ventilation port formed below the refrigerant release valve.

8. The heat pump apparatus of claim 7, wherein the refrigerant release valve is provided downstream of the heat-medium heat exchanger in a flow direction of the heat medium.

* * * * *